US006681097B2

(12) United States Patent
Kimura et al.

(10) Patent No.: US 6,681,097 B2
(45) Date of Patent: Jan. 20, 2004

(54) SHEET POST-TREATMENT DEVICE AND IMAGE FORMING APPARATUS PROVIDED WITH THE SAME

(75) Inventors: Hideki Kimura, Saitama (JP); Hiroshi Kawamoto, Hasuda (JP); Kazuhisa Mochizuki, Yamanashi-ken (JP)

(73) Assignees: Fuji Xerox Co., Ltd., Tokyo (JP); Nisca Corporation, Yamanashi-ken (JP)

( * ) Notice: Subject to any disclaimer, the term of this patent is extended or adjusted under 35 U.S.C. 154(b) by 0 days.

(21) Appl. No.: 10/265,380

(22) Filed: Oct. 7, 2002

(65) Prior Publication Data

US 2003/0072593 A1 Apr. 17, 2003

(30) Foreign Application Priority Data

Oct. 15, 2001 (JP) ..... 2001-317364

(51) Int. Cl.[7] ..... G03G 15/00

(52) U.S. Cl. ..... 399/405; 399/407; 399/408; 399/410

(58) Field of Search ..... 399/401, 402, 399/403, 404, 405, 407, 408, 410; 270/58.12, 58.27

(56) References Cited

U.S. PATENT DOCUMENTS 6,430,388 B1 * 8/2002 Hirai et al. ..... 399/401
6,473,590 B2 * 10/2002 Matsumoto et al. ..... 399/404
6,546,226 B2 * 4/2003 Sato et al. ..... 399/382

* cited by examiner

*Primary Examiner*—Hoang Ngo
(74) *Attorney, Agent, or Firm*—Kanesaka & Takeuchi

(57) ABSTRACT

A sheet post-treatment device for receiving a sheet discharged from an image forming apparatus to accumulate and match it comprises: routes including a first conveying route for receiving the sheet discharged from the image forming apparatus; a switch-back route for inverting the received sheet; a second conveying route for conveying the inverted sheet; and a third conveying route for delivering the sheet conveyed onto a treating tray for accumulating and matching the sheet thereon, the switch-back route being arranged downward of the treating tray. The second conveying route is formed along the side wall of the sheet post-treatment device, and at least a part of the switch-back route is exposed.

20 Claims, 10 Drawing Sheets

SHEET POST-TREATMENT DEVICE AND IMAGE FORMING APPARATUS PROVIDED WITH THE SAME

BACKGROUND OF THE INVENTION

The present invention relates to a post-treatment device for carrying out treatments such as accumulating a plurality of sheets discharged from an image forming apparatus such as a copying device or a printer to match them, and stapling (staple) a bundle of sheets thus matched, and an image forming apparatus provided with such a sheet post-treatment device as described.

The image forming apparatus receives image data to be printed from a data treatment device, for example, such as an image reading device, a facsimile device, or a computer, to form a printed image on the sheet on the basis thereof.

The sheet post-treatment device receives a sheet after image formation from the image forming apparatus to discharge it onto a sheet discharge tray. However, in case where a plurality of sheets after image formation are present, ends of a bundle of sheets are matched; or the ends of a bundle of sheets are subjected to stapling as necessary; and as the case may be, post-treatment such as boring a punch hole is carried out. The bundle of sheets applied with such a post-treatment as described is finally stacked sequentially on the accumulation tray, and taken out by an operator.

However, some image forming apparatuses are of the type in which where one set of a plurality of sheets after image formation is received by the post-treatment device to stack them, the sheets are discharged in the state that both sides of the sheet are reversed.

Accordingly, it is necessary for the sheet post-treatment device used for such an image forming apparatus as described to provide, internally thereof, a switch-back mechanism for inverting both sides of a sheet before a series of sheets are accumulated and matched.

In such a switch-back mechanism as described, normally, a switch-back route need be secured without fail within the post-treatment device, and therefore, the sheet post-treatment device having a switch-back function should have been formed into a larger size.

However, it has been pressed greatly that peripheral optional apparatuses as well as the sheet post-treatment device are necessarily made into a type as small as possible without impeding readiness of taking out sheets while adjusting to the miniaturization of the image forming apparatus itself.

Further, where the switch-back for inverting both sides of a sheet is carried out inside the device, since the switch-back is to be carried out in a narrow bended space within the device, jamming tends to occur. Further, since in taking out the sheet jammed within the device, the switch-back route within the device has to be placed in an open state, the taking-out work was cumbersome.

Furthermore, since the shape of a sheet is changed, or accessories are add to the sheet whereby the post-treatment is applied to the sheet, the jam tends to occur, and where the jam occurs actually, securing of readiness of releasing the jam in a portion for carrying out the post-treatment such as staple or punch in which treatment of releasing the jam is more difficult than the switch-back route is all extremely important design matter for the sheet post-treatment device and the image forming apparatus.

It is therefore an object of the present invention to provide a sheet post-treatment device in which a sheet post-treatment device having a switch-back function as described above is realized in an extremely compact size without impeding the readiness of taking out sheets, and possibility of occurrence of jams in a portion where switch-back is carried out and a portion for applying post-treatment to a sheet is greatly reduced, and even if the jam should occur at the worst, one can cope therewith easily.

SUMMARY OF THE INVENTION

Therefore, the present invention provides a sheet post-treatment device, comprising: sheet carrying-in means for receiving a sheet discharged from an image forming apparatus: switch-back means for switch-back conveying the sheet received from the sheet carrying-in means; inversion means for inverting both sides of the sheet received from the switch-back means; discharge means for discharging the sheet whose both sides are inverted by the inversion means; loading means provided upward of the switch-back means to load the sheet discharged by the discharge means; post-treatment means for post-treating the sheet loaded on the loading means; and housing means for housing tile sheet subjected to post-treatment by the post-treatment means.

Thereby, in the present invention, since the switch-back means is housed in a lower space of the treating tray necessitated originally, it is possible to have a size nearly similar to that of a sheet post-treatment device having no switch-back function, and the loading means for applying post-treatment by which jam treatment is difficult is arranged upward of the switch-back means to facilitate the jam treatment.

Further, since the switch-back means is formed in a straight line, and at least one of them is exposed, jam is hard to occur in a sheet, and even if the sheet jam should occur at the worst, one can deal therewith by easy constitution.

The present invention is characterized in that the post-treatment means comprises a post-treatment unit for applying prescribed treatment to a sheet load on the loading means, and moving means for moving the post-treatment unit along one end of the sheet loaded on the loading means.

Thereby, the complicated post-treatment unit having the moving constitution is installed upward of the switch-back means, and one can deal therewith by easy constitution.

The present invention is characterized in that at least one of the post-treatment means and the moving means is arranged within a region surrounded by the switch-back means, the inversion means, and the loading means.

Thereby, the post-treatment device or the moving means for moving the post-treatment device is arranged making use of a region or space surrounded by the switch-back means, the inversion means, and the loading means. The device can be further miniaturized.

The present invention is characterized in that the inversion means is constituted by a nearly ⊐-shaped conveying route provided between the switch-back means and the loading means.

Thereby, the switch-back means and the loading means can be provided on the same side with respect to the inversion means, the device can be further miniaturized as compared with the case where the switch-back means and the loading means are provided in an opposing direction with the inversion means put therebetween. Further, a space whose three sides are surrounded by the nearly ⊐-shaped conveying route can be prepared, in which space the post-treatment means or the means for moving the post-treatment means can be arranged, likewise enabling contribution to the miniaturization of the device.

The present invention is characterized in that the switch-back means has second housing means for temporarily guiding a sheet to be inverted.

Thereby, in switching-back a sheet, the sheet can be switched-back in an adequate attitude without being hung down.

The present invention is characterized in that the switch-back means discharges a sheet not inverted to the second housing means. Thereby, the space necessary for the switch-back can be utilized as means for discharging and housing the sheet, thus providing merits of increasing the sheet housing capacity, or capable of sorting and housing sheets.

The image forming apparatus according to the present invention is characterized by the provision of the sheet post-treatment device according to claims 1 to 6.

Thereby, there can provide merits that as the entire image forming apparatus provided with the sheet post-treatment device, miniaturization can be achieved; and occurrence of jam is suppressed, and even if the jam should occur, releasing thereof is easy.

DESCRIPTION OF THE PREFERRED EMBODIMENTS

Embodiments of a sheet post-treatment apparatus of the present invention and an image forming apparatus provided with the sheet post-treatment apparatus will be described in detail hereinafter with reference to the drawings.

Figure 1:
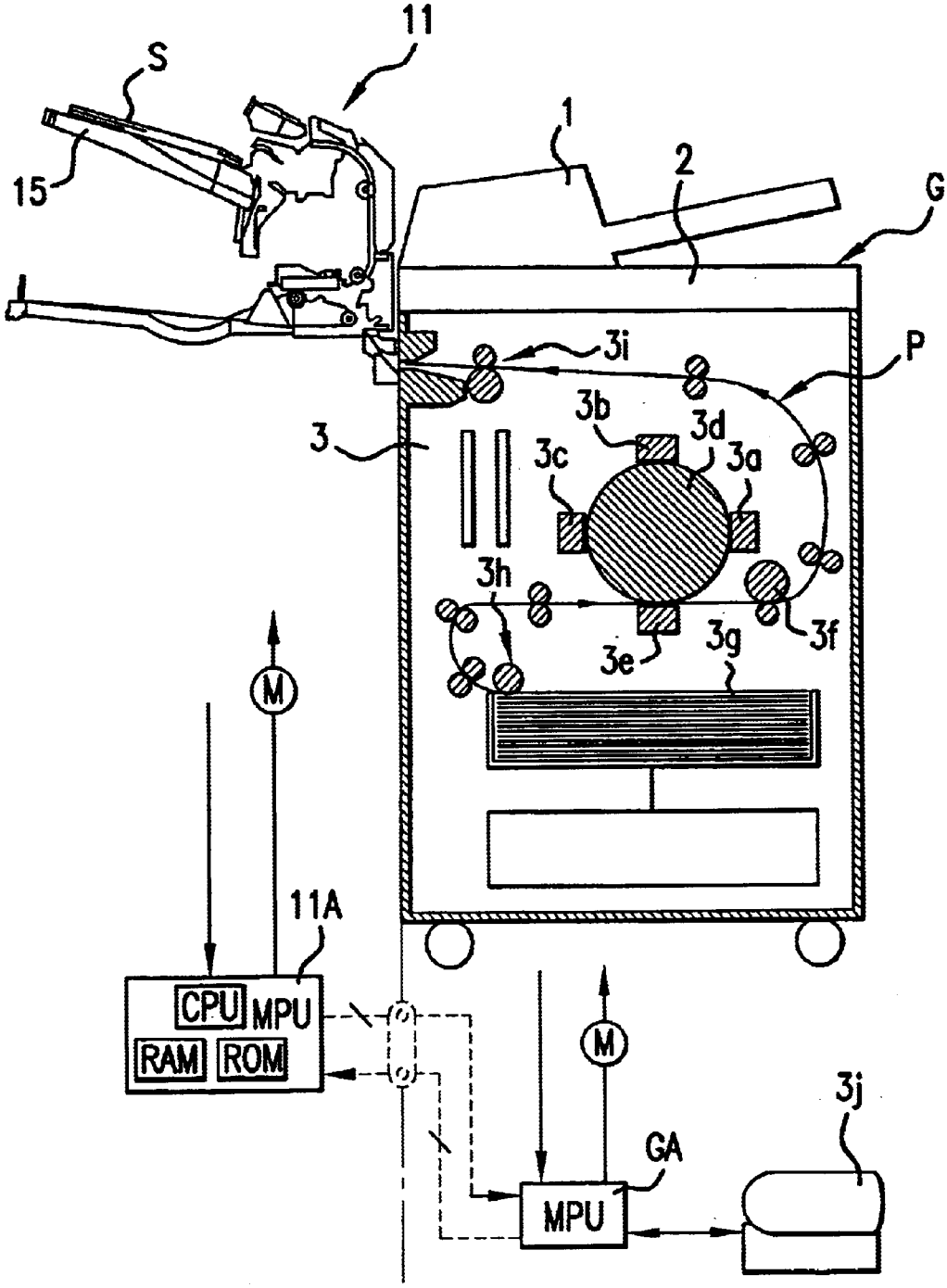
FIG. 1 is a schematic view showing the entire constitution according to an embodiment of the present invention.

FIG. 1 is a schematic view showing the entire constitution according to an embodiment of the present invention.

In FIG. 1, there is constituted by an image forming apparatus G such as a copying machine, a printer or the like, and a sheet post-treatment device 11 as a sheet discharge device. The sheet post-treatment device 11 has the construction that can be detachably mounted on the image forming apparatus G.

The image forming apparatus G shown in FIG. 1 shows the constitution of main parts of a known copying machine or a printer, and is provided with a scanner (an image read device) 2 below an automatic original feeder (ADF) 1. An image producing portion (a printer engine) is arranged below the scanner 2.

Figure 2:
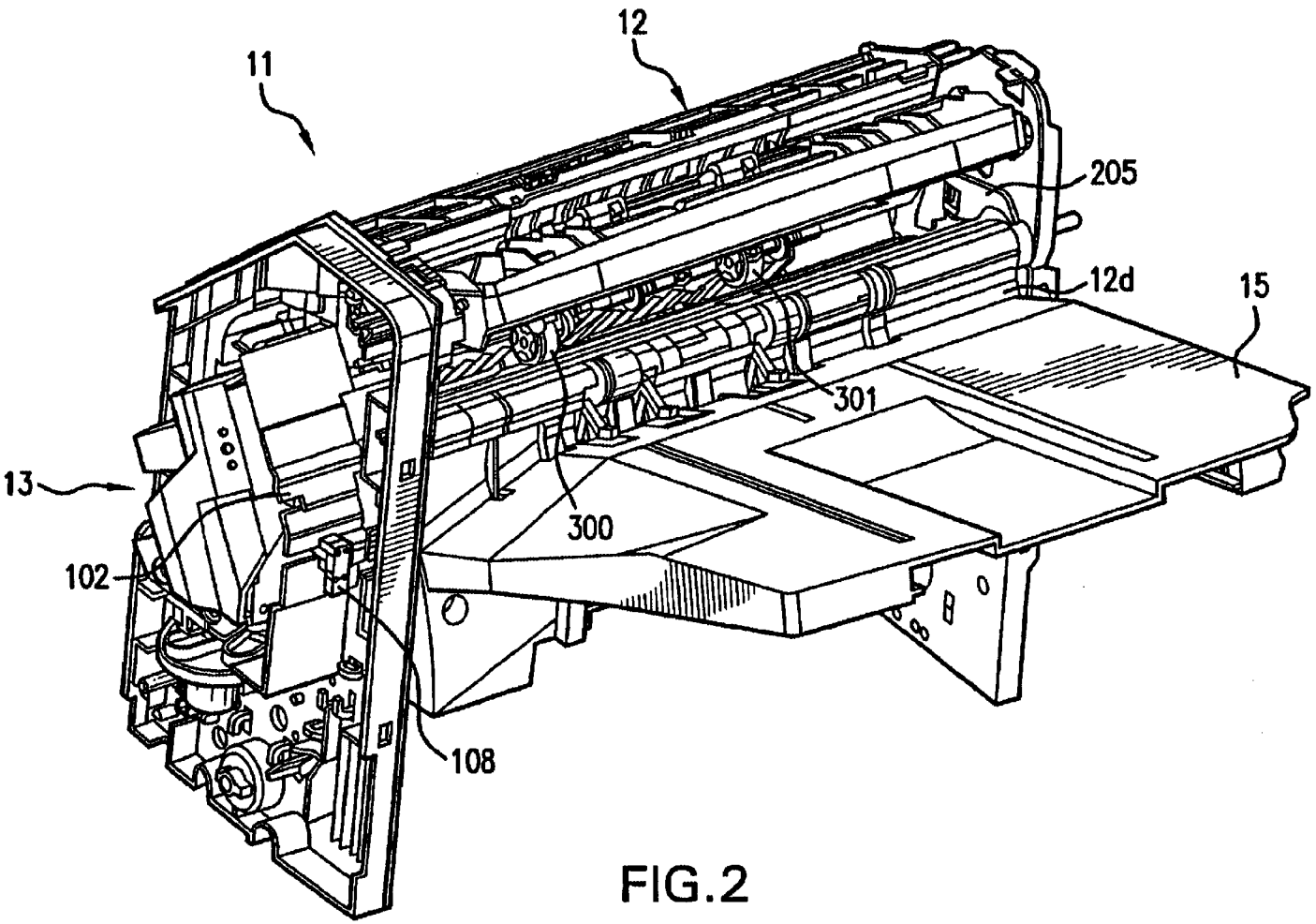
FIG. 2 is a perspective view showing the external appearance constitution of main parts of a sheet post-treatment apparatus shown in FIG. 1.
Figure 3:
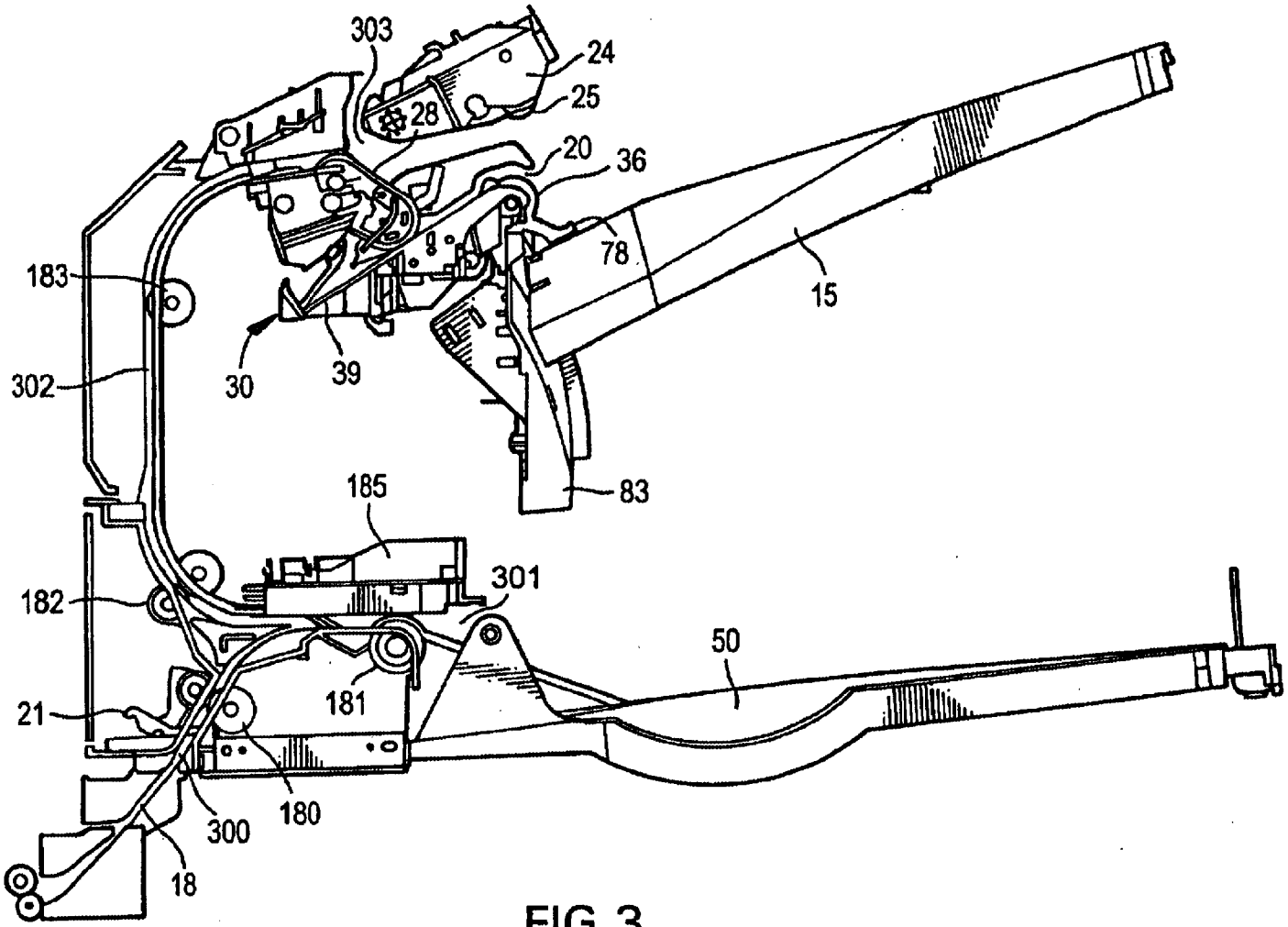
FIG. 3 is a side view showing the internal appearance constitution of main parts of a sheet post-treatment apparatus shown in FIG. 1.

FIG. 2 is a perspective view showing the external appearance constitution of main parts of the sheet post-treatment device 11 in the state that a cover is removed, and FIG. 3 is a perspective view showing the internal appearance constitution of main parts of the sheet post-treatment device 11.

In FIGS. 1 and 2, the sheet post-treatment device 11 is provided with a body device 12, a staple unit 13 for stapling a sheet bundle arranged on one side frame of the body device 12 to constitute a post-treatment means for applying the post treatment to a sheet, and a driving force transmission mechanism 14 arranged on the other side frame of the body device 12.

The present device is provided with a receiving inlet 18 to which a sheet formed with an image discharged from the image forming device G is supplied, an inversion tray 50 for forming a switch-back route for inverting both sides of a sheet S supplied from the receiving inlet, a discharge outlet 20 formed on the surface on the side opposite the receiving inlet 18, and an accumulation tray 15 as a housing means for accumulating the sheet S discharged from the discharge outlet 20.

The inversion tray 50 for inverting the sheet S is provided at a lower position of the accumulation tray 15. The accumulation tray 15 is provided above the sheet post-treatment device 11, and a lower portion of the accumulation tray is a vacant space. The inversion tray 50 is arranged in the vacant space to thereby realize the space saving on the side of the image forming apparatus G, enabling miniaturization of the sheet post-treatment device 11.

Now, a switch-back route 301 and a vertically movable matching member 101 in the sheet post-treatment device 11 according to the present invention will be described in detail with reference to FIGS. 3 and 4.

Figure 4:
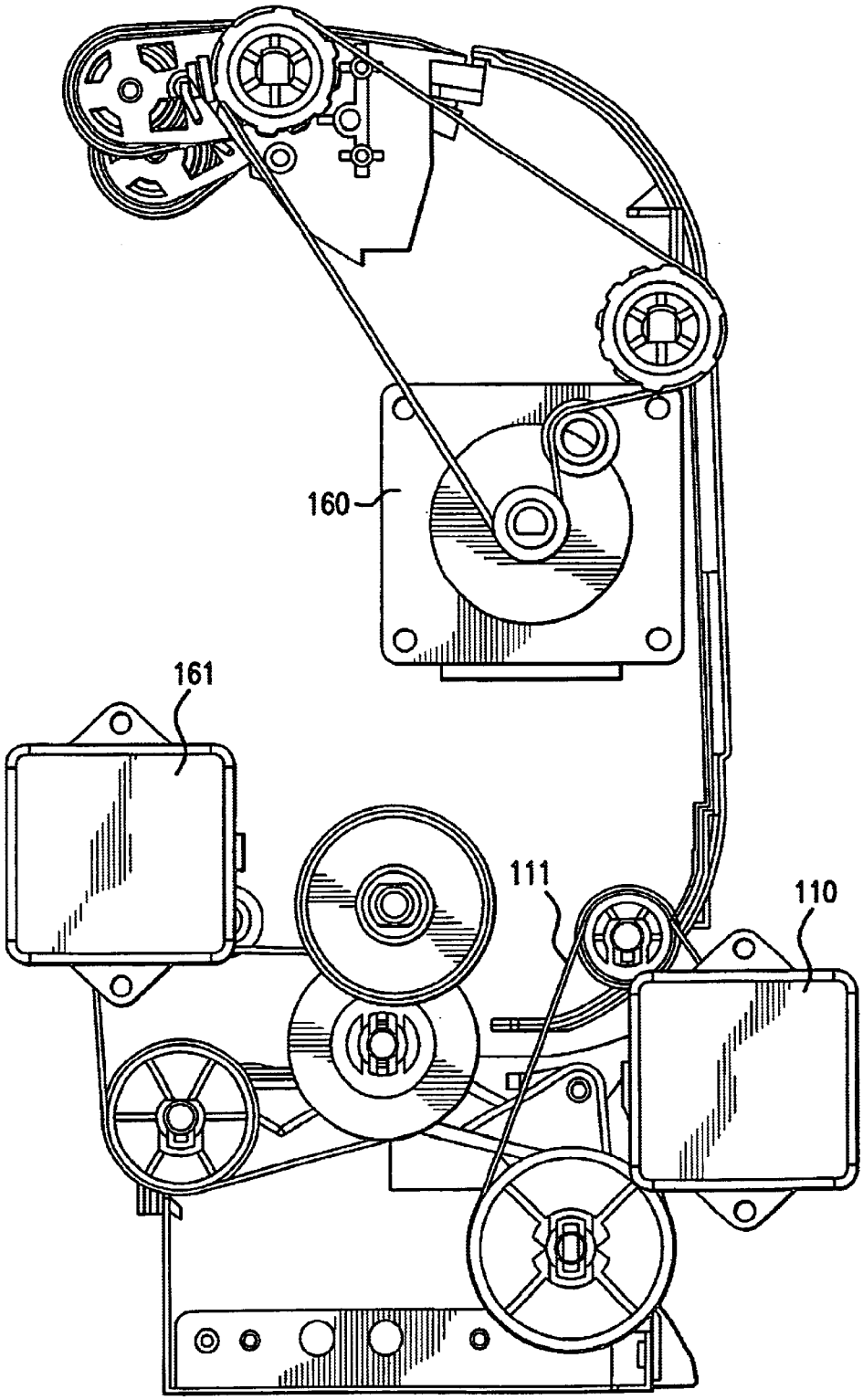
FIG. 4 is an outline view of a driving mechanism arranged along the second conveying route in the present apparatus.

FIG. 4 is an outline view of a driving mechanism arranged along a second conveying route 302 as an inversion means.

Depending on the image forming apparatus, there is a type of discharging in the state that one set of a plurality of sheets after image formation is received by the sheet post-treatment device and in case where they are laminated as it is, both sides of a sheet are reversed.

Accordingly, it is necessary for the sheet post-treatment device used in such an image forming apparatus as described to provide internally thereof with a switch-back mechanism for inverting both sides of a sheet before accumulating and matching a series of sheets.

The sheet post-treatment device 111 according to the present invention is formed with routes including a first conveying route 300 for receiving a sheet S discharged from the image forming apparatus G, a switch-back route 301 for switching back the received sheet, a second conveying route 302 as an inversion means for inverting and conveying the sheet switched back, and a third conveying route 303 for delivering the conveyed sheet S onto the treating tray 39 as a loading means for accumulating and matching the conveyed sheets. A switch-back roller 181 as a switch-back means and a switch-back route 301 are arranged below the treating tray 39.

As described above, in the present device, the switch-back roller 181 as a switch-back means and the switch-back route 301 are received in the space below the treating tray 39 which has been a vacant space originally. With this constitution, the sheet post-treatment device 11 of the present invention becomes enabled to have a size substantially similar to that of a sheet post-treatment device 11 having no switch-back function, and a post-treatment tray in which jamming easily occurs, and the treatment for removing the jam is difficult is arranged above the post-treatment tray, whereby even if the jam occurs, the treatment of removing it is facilitated.

The switch-back device of the present invention is constituted by an inversion sensor 185 for detecting an extreme end and a rear end of a sheet, a switch-back roller 181 to be normally rotated and reversionally rotated in order to convey a sheet, an inversion tray 50 as a second housing means for placing a sheet as a guide temporarily, and an inversion motor 161 for driving the switch-back roller 181.

It is noted that with respect to a sheet not inverted, the sheet can be also discharged onto the inversion tray 50 without inverting the switch-back roller 181.

As shown in FIG. 3, the second conveying route 30 as an inversion means is formed to have a nearly ⊐-shape. The third conveying route 303, the second conveying route, and the switch-back route 301 are arranged in a nearly ⊐-shape as a whole also, and the first conveying route 300, he switch-back route 301 and the second conveying route 302 are constituted so as to form a three-forked road.

Since the second conveying route is provided in a nearly vertical direction as described above, a necessary space forward in a sheet discharging direction of the device can be made small. Further, since the switch-back route 301 is formed in a straight line and at least a part thereof is exposed, jamming of a sheet is hard to occur, and even if sheet jamming should occur at the worst, one can deal with it easily.

As shown in FIG. 4, an inlet motor 110, an inversion motor 161, and a conveying motor 160 are disposed along the conveying route, and in these motors, driving is transmitted to the devices by a driving transmission member such as a belt, a gear, or a rotational shaft. Since the motor and the driving transmission member are disposed along the conveying route, as described, miniaturization of the sheet post-treatment device 11 can be realized.

In the inlet motor 110, driving is transmitted from a driving shaft thereof not shown to driving gears 480 and 482 by a driving belt 111 to rotate an inlet roller 189 and a conveying roller 182 arranged on the same shaft as that of the driving gear 482.

In the inversion motor 161, driving is transmitted from a driving shaft thereof not shown to a driving gear 481 by a driving belt 115 to rotate the switch-back roller 181 arranged on the same shaft as that of the driving gear 481.

In the conveying motor 160, driving is transmitted from a driving shaft thereof to a driving gear 483 by the driving belt 116 to rotate the conveying roller 183 arranged on the same shaft as that of the driving gear 483.

Now, the switch-back operation for inverting a sheet S in the sheet post-treatment device 11 of the present invention will be described hereinafter.

A sheet S discharged from the image forming device G is fed to the receiving inlet 18 of the sheet post-treatment device 11 by a discharge roller 184 of the image forming apparatus At this time, the sheet S is conveyed with a print image surface directed on its lower surface side.

The inlet motor 110 and the conveying motor 160 begin to drive in normal rotation. First, an inlet sensor 21 detects presence of the sheet S, and the sheet S is present, the sheet S is conveyed on the first conveying passage 300 constituting a carrying-in means by the inlet roller 180 constituting a carrying-in means. When the conveyance of prescribed distance of the sheet S is detected, the inversion motor 161 starts to drive in normal rotation. When the fact that a rear end of the sheet has moved away from the inlet sensor 21 is detected, the inversion motor accelerates its driving in normal rotation. The sheet S is conveyed to the switch-back route 301 by the switch-back roller 181 and is guided to the inversion tray 50. When the sheet is conveyed by prescribed distance, and the inversion sensor 185 detects the rear end of the sheet S, the inversion motor 161 stops. At this time, the sheet S is in the state of being nipped between the par of switch-back rollers 181.

Next, the inversion motor 161 starts its inversion driving. The sheet S is started to be conveyed in the direction opposite to that when being conveyed by the switch-back roller 181 driven in inversion rotation. The sheet is guided, on the switch-back route, by a conveying guide 186, and is conveyed to the upwardly extending second conveying route 302. At this time, the sheet S is conveyed with its print image surface directed on the image forming apparatus G side.

When the sheet S is conveyed by prescribed distance, and when the inversion sensor 185 detects the end of the sheet S, tile inversion motor 161 stops.

After having been inversion-conveyed on the second conveying route 302, the sheet S is guided by an endless conveying belt 28 is accumulated and matched on the treating tray 39 with the print image surface directed on tile tray surface side (directed downward) via the third conveying route. When this conveyance is carried out by the prescribed number of sheets, and the conveyance of the prescribed number of sheets is terminated, they are subjected to stapling and discharged.

Figure 5:
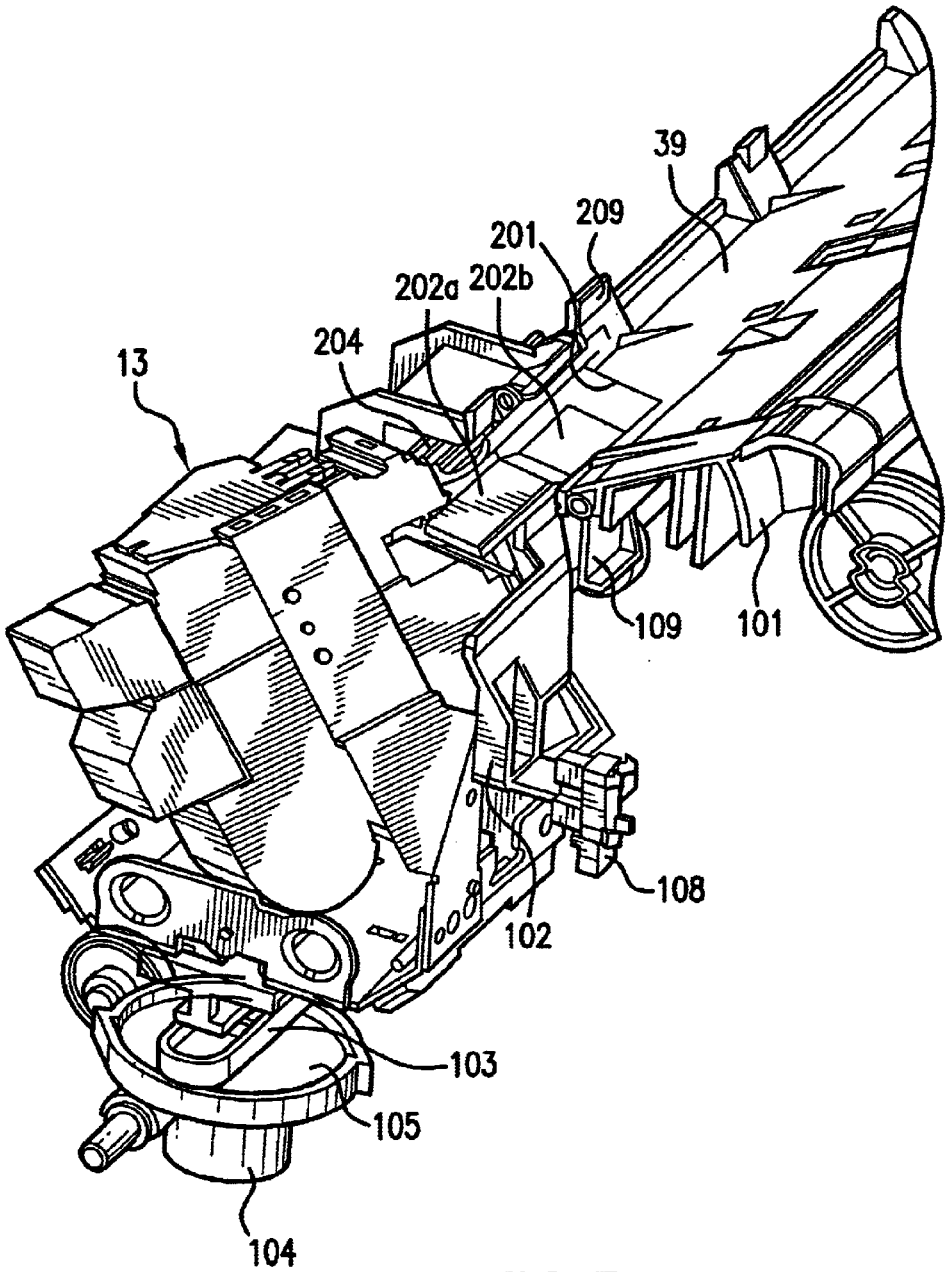
FIG. 5 is a perspective view showing, in an enlarged scale, a portion of a treating tray and a constitutional portion of a staple unit of the present sheet post-treatment apparatus, further showing the state that a matching member is moved down.
Figure 6:
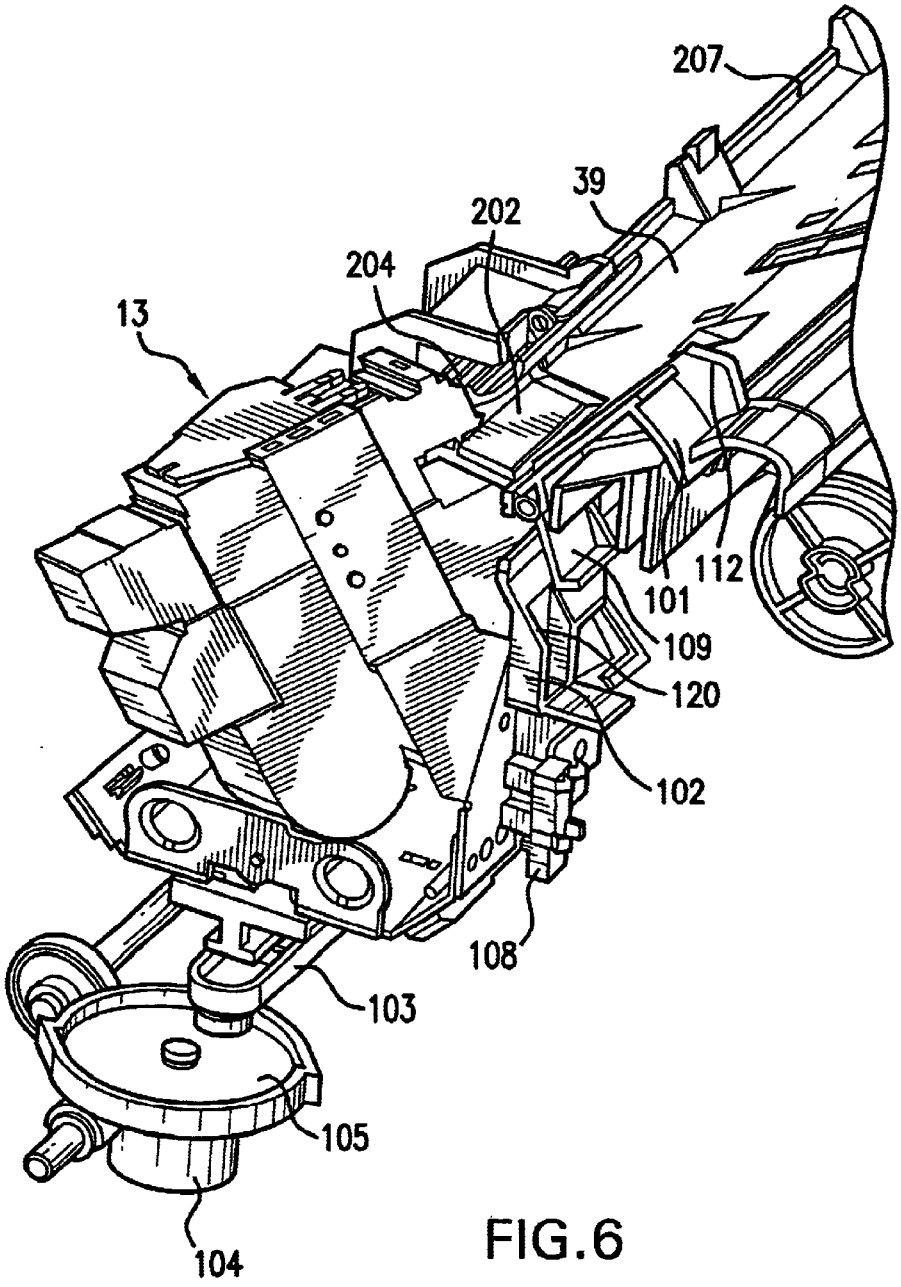
FIG. 6 is a perspective view showing, in an enlarged scale, a portion of a treating tray and a constitutional portion of a staple unit of the present sheet post-treatment apparatus, further showing the state that a matching member is moved up.

FIGS. 5 and 6 are respectively perspective views showing, in an enlarged scale, a portion of the treating tray 39 of the sheet post-treatment device and a portion of a staple unit 13 constituting a post-treatment means for applying post-treatment to a sheet.

A part on the staple unit 13 side of the treating tray 3 is notched so that the staple unit 13 may be moved, and a notch portion 201 is formed as a moving route of the staple unit 13. If a notch is not provided, the moved staple unit 13 staples the treating tray 39. In the staple unit 13, a slide tray 202 corresponding to the notch portion is fixedly mounted and integrally formed.

Further, the treating tray 39 is formed with an inclined surface for guiding a sheet to a stapler position. A sheet S conveyed to the treating tray 39 is guided to the stapler position along the inclined surface.

Figure 10:
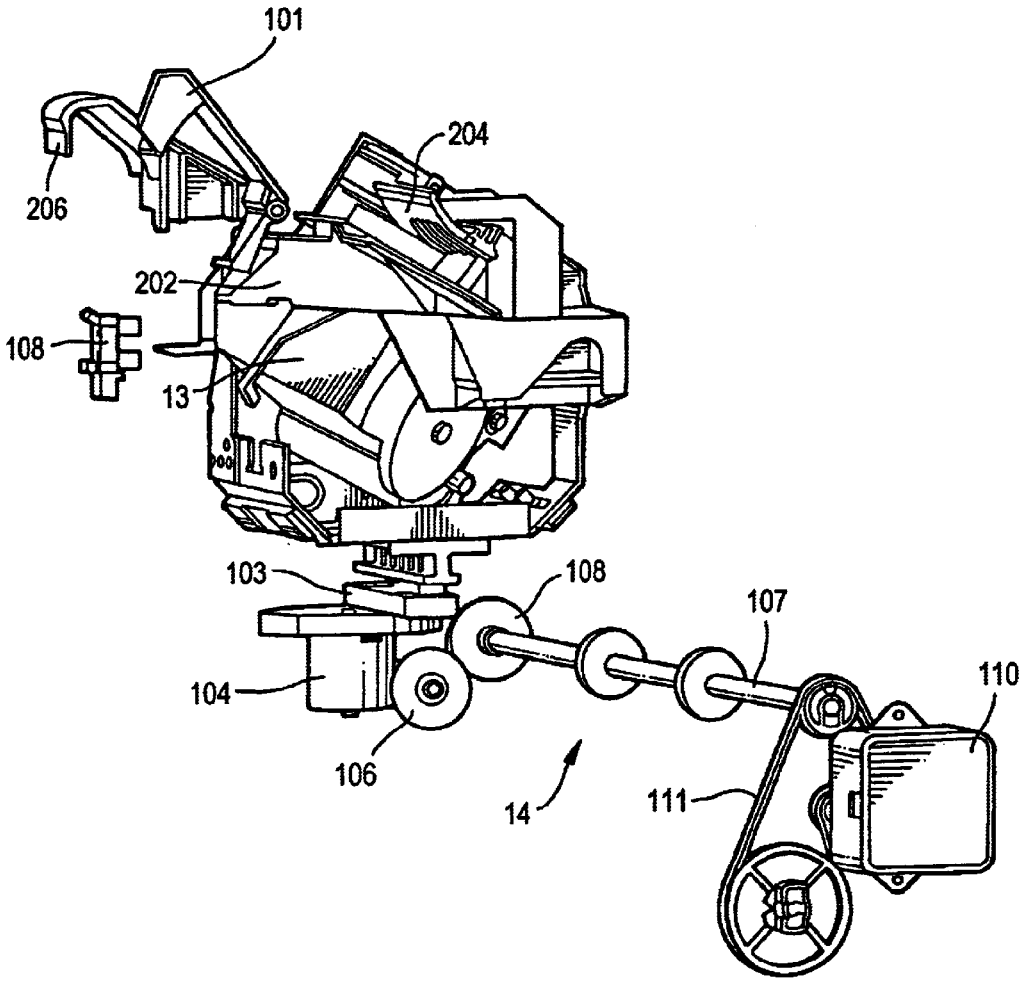
FIG. 10 is an outline view of a driving force transmission mechanism 14 for carrying out driving of a conveying roller and moving of a staple unit, formed in the present post-treatment apparatus.

FIG. 10 is an outline view of a driving force transmission mechanism 14 as a moving means for carrying out driving of a rotational shaft 107 formed on the sheet post-treatment device 11 and movement of the staple unit 13.

Next, the constitution of movement of the staple unit 13 will be described.

A request signal of operation corresponding to a sheet S of a small size is transferred from the image forming apparatus G to the sheet post-treatment device 11. The inlet motor 110 starts its reversal rotation. The inlet motor 110, when driven in normal rotation, drives the inlet roller 180. Tile rotation is transmitted to a one-way clutch gear 108 through the rotational shaft 107 driven by the belt 111. The rotation is transmitted to a worm gear 106 through the one-way clutch 108, and the worm gear 106 rotates a worm wheel 104.

There is provided a crank lever 103 having one end connected free to turn in contact with the inside of a wall surface of a peripheral edge of a concave rotational board 105 provided above the worm wheel 104. The other end of the crank lever 103 is connected free to turn to the staple unit 13.

When the worm wheel 104 rotates, the connecting portion of the crank lever 103 moves along the edge of the rotational board 105 as the rotational board rotates. Rotational motion of the rotational board 105 is converted into linear motion by the crank lever 103. The crank lever 103 is to carry out piston motion.

The connecting portion between the crank lever 1()3 and the worm wheel 104 in FIG. 5 is positioned externally of the staple unit 13, and the staple unit 13 is at a home position. As the worm wheel 104 rotates, the connecting portion with the crank lever 103 is on the staple unit 13 side. With this, the crank lever 103 is forced into the staple unit 13 side. The staple unit 13 connected to the crank lever 103 is pushed by the crank lever 13 and moves to the treating tray 39 side (the body device 12 side).

Next, the matching member 101 free to turn to be moved vertically adjusting to the size of a sheet S in the sheet post-treatment device 11 will be described briefly.

With the conveyance of a sheet S from the image forming apparatus G, a request signal of shift operation (here, the stapling in the shift operation described above) and operation of the staple unit 13 according to the size of the sheet S is transferred to the sheet post-treatment device 11. Switching between a shift operation mode and a straight operation mode is carried out by the signal. When the movement is necessary from judgment of the present position of the staple unit 13 and a position newly requested, the staple unit 13 is moved to a position corresponding to the request. A pushing-up member 102 is formed integral with the staple unit 13.

In FIG. 5, the treating tray 39 and the staple unit 13 show the state that sheets S of a group A which is a large size are treated. The matching member 101 moves down, and the tray surface of the treating tray 39 and the tray surface of the matching member 101 are in the same plane. The position of the staple unit 13 is a home position of the staple unit 13.

FIG. 6 shows the state that the treating tray 39 and the staple unit 13 Treat a small size sheet S. The movable matching member 101 of the treating tray 39 moves and is pushed upward by the pushing-up member 102 provided on the staple unit 13 as the staple unit 13 moves. The moved and pushed up matching member 101 is a matching reference adjusted to the size of a sheet S. The width of the treating tray 39 is narrow adjusting to the sheet.

Further, with respect to switching from a treating position of a sheet S of A5 size to treatment of a sheet S of A3 size reversally to the aforementioned operation, the following operation is carried out. A request signal of operation corresponding to a sheet S of a large size such as A3 size is transferred to the sheet post-treatment device 11 from the image forming apparatus G. When the sheet post-treatment device 11 receives the request signal of operation of the staple unit 13, operation of movement of the staple unit 13 begins.

When the staple unit 13 starts to move, the pushing-up member 102 provided on the staple unit 13 moves along with the stable unit 13 and is joined with the home position sensor 108. At this time, a pushing portion 120 of the pushing-up member 102 moves away from a contact portion 109 of the matching member 101, and the matching member 101 turns and moves downward. The surface of the matching member 101 assumes the same level surface as the tray surface of the treating tray 39. In this manner, the sheet S can be matched at a matching reference adjusted to the size.

Sheets S are conveyed from the receiving inlet 18 on the first conveying route and are switch-back conveyed from the second conveying route along the third conveying route, and a plurality of sheets are placed on the treating tray 39 and matched. And after stapling has been carried out by the staple unit 13, a bundle of sheets is discharged onto the accumulating tray 15.

The first conveying route 300 has the inlet sensor 21 for detecting an end of a sheet and the inlet roller 180 and is extended to the switch-back route 303. The switch-back route 301 has the switch-back roller 181 and the inversion sensor 185 for detecting an end of a sheet and is extended to the inversion tray 50.

The second conveying route 302 has the endless conveying belt 28 for conveying a sheet S to the third conveying route 303. A treating tray unit 30 is provided below the endless conveying belt 28. The treating tray unit 30 has a function as a loading unit for temporarily placing a sheet S in order that the endless conveying belt 28 rotates to draw the sheets S sequentially and stapling is carried out with respect to every bundle of the sheets S by stapling. Further, one reference side of the treating tray 3 forms a fixed matching reference.

The second conveying route 302 as an inversion means is formed to have a nearly ⊐-shape. The second conveying route 302 is curved from the switch-back route 301 and extends to the conveying roller 182, and the second conveying route 302 of the conveying roller 183 from the conveying roller 182 is provided to be stood upright nearly vertically, and provided toward the discharge outlet 20 curving from a conveying roller 183.

At least one of the driving force transmission mechanism 14 and the staple unit 13 is arranged within the space or the region surrounded by the second conveying route 302, the switch-back roller 181 and the treating tray 39 to save the space.

Further, a turning unit 24 which rotates up and down about a paddle driving roller shaft is provided above the second conveying route 302. When a bundle of sheets S within the treating tray unit 30 is discharged to the accumulation tray 15, the turning unit 24 moves to a lower position, and when the sheets are guided to the third conveying route 303 to the treating tray unit 30, the turning unit 24 moves to an upper position.

A driven discharge roller (a bundle discharge roller) 25 is provided within the turning unit 24. The driven discharge roller 25 is provided in order to discharge sheets S or a bundle of sheets S from the discharge outlet 20 to the accumulation tray 15. A discharge roller 36 is arranged, opposing to the driven discharge roller 25, in the discharge outlet 20.

A sheet knocking member 12*a* for controlling an end edge of a sheet S accumulated on the accumulation tray 15 is constituted integral with a front frame of the body device 12 below the discharge roller 36. There is provided a sheet keep lever 78 which appears and disappears from an upper position of the sheet knocking member 12*a* close to the discharge roller 36 of the sheet knocking member 12*a* towards the accumulation tray 15. The sheet keep lever 78 moves so as to project towards the accumulation tray 15 at the time when the sheets S or a bundle of sheets S are discharged by the discharge roller 36 and the driven discharge roller 25.

As described above, the sheets S conveyed from the first conveying route are accumulated on the treating tray 39 via the third conveying route by the endless conveying belt 28. There is a plurality of sizes for sheets S. Sheets of different sizes are accumulated and matched, and a prescribed position of the sheet S is stapled by the staple.

In matching the sheets S, since an end of a sheet on the treating tray is adjusted to a matching reference in one direction going through in a direction of discharging a sheet, the sheet S is matched by pressing it by a pressing means 205 for moving the sheet S in a direction of the matching reference.

Figure 7:
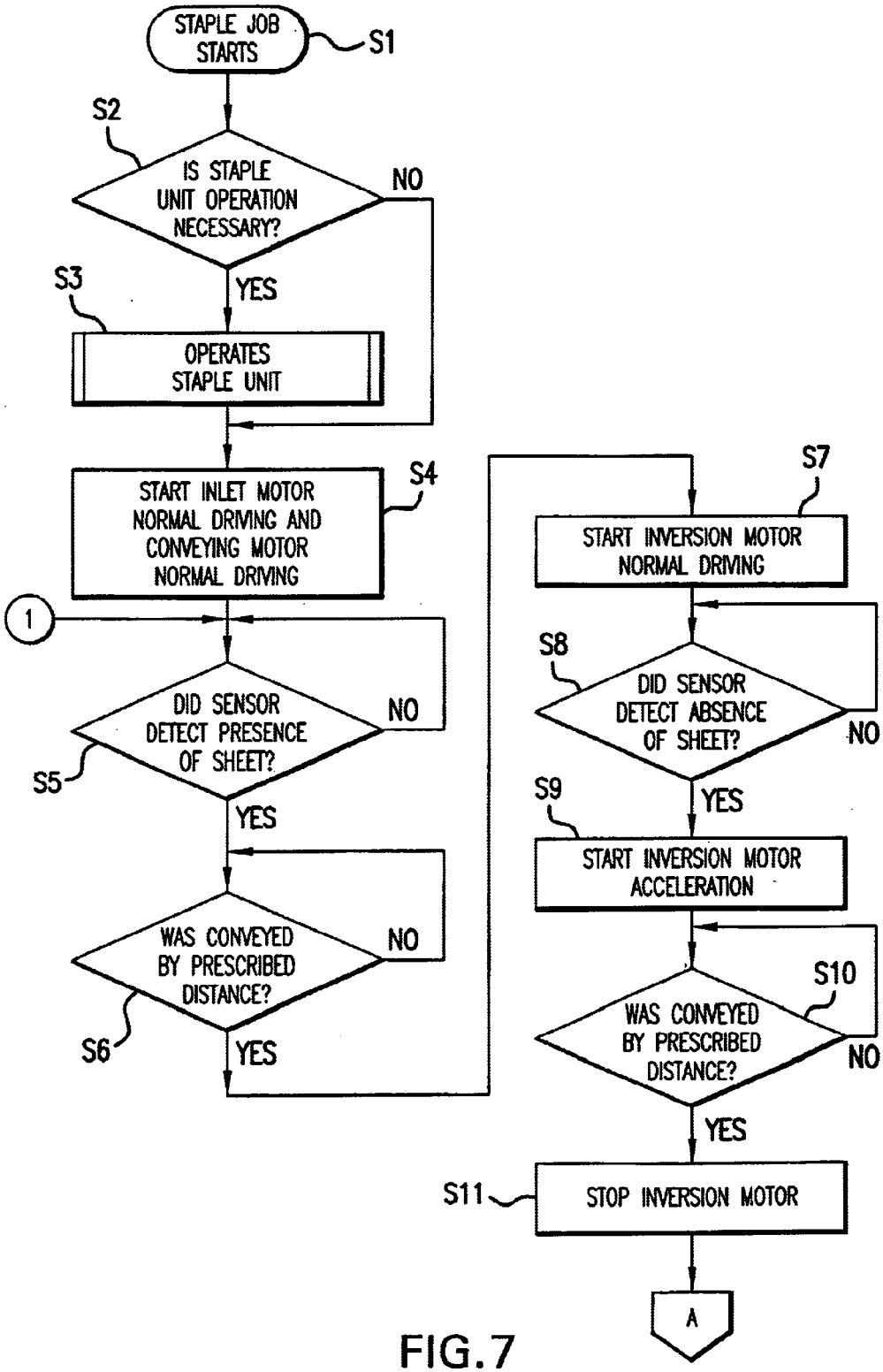
FIG. 7 is a block diagram (first) for explaining operation control of a shift operation mode (stapling) in the present apparatus.
Figure 8:
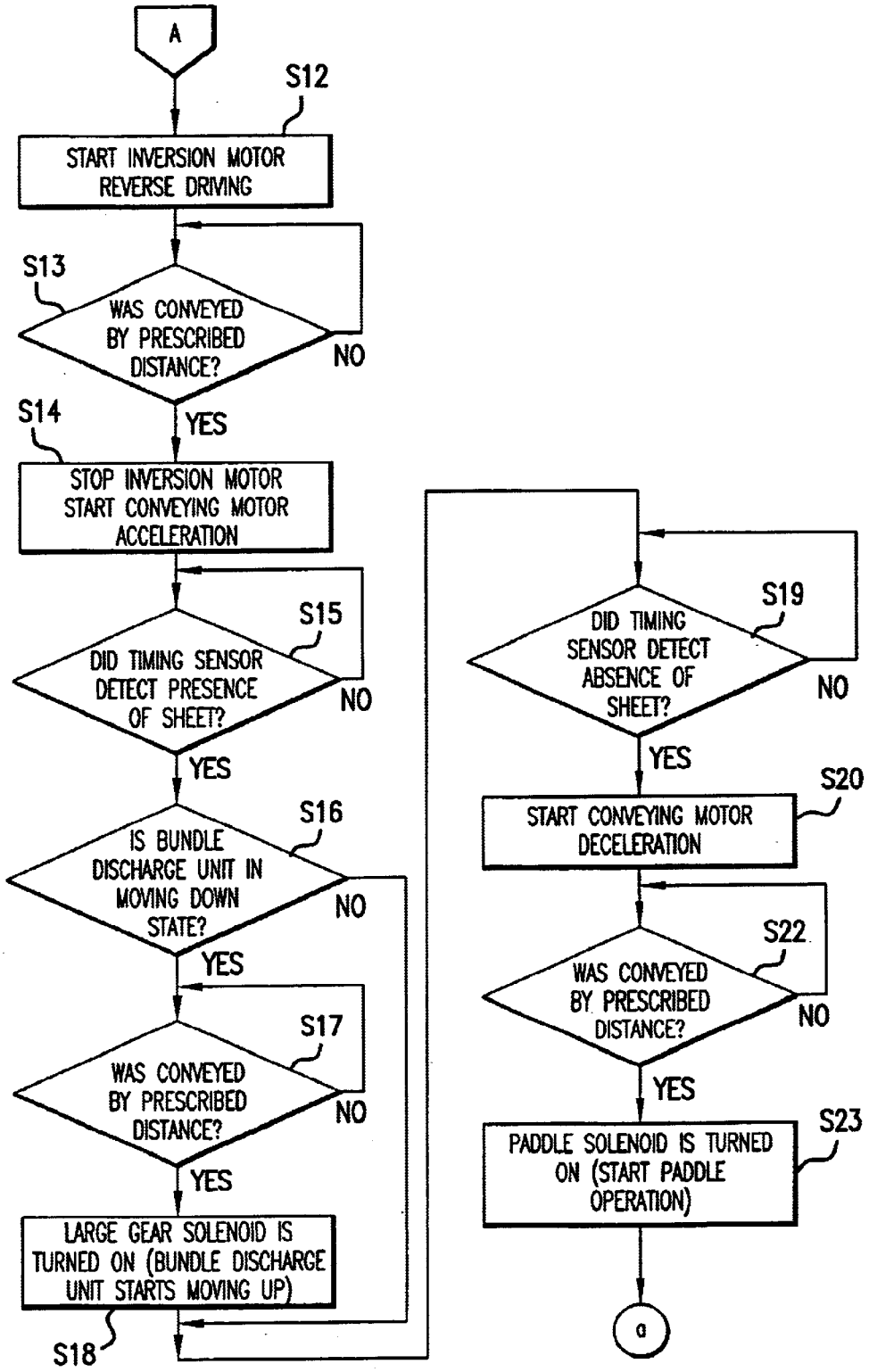
FIG. 8 is a block diagram (second) for explaining operation control of a shift operation mode (stapling) in the present apparatus.
Figure 9:
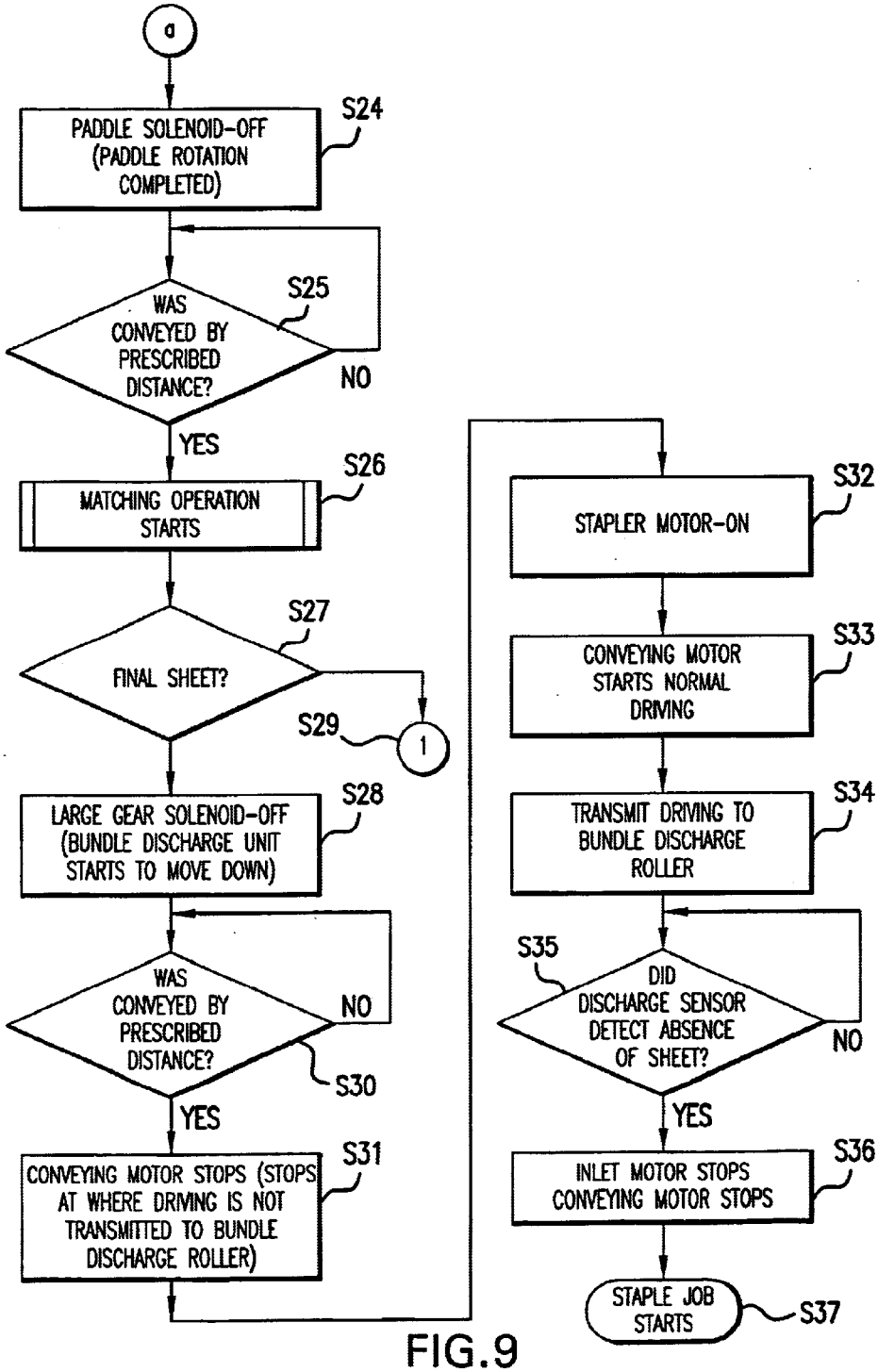
FIG. 9 is a block diagram (third) for explaining operation control of a shift operation mode (stapling) in the present apparatus.

Next, an outline of operation control in the present sheet post-treatment device will be described on the basis of flowcharts shown in FIGS. 7, 8 and 9, respectively.

When the staple treatment starts (S1), first, necessity of movement of the staple unit 13 is judged from information of the sheet S size (S2). If the movement is necessary, moving operation of the staple unit 13 is carried out (S3). The movement of the staple unit 13 is carried out when the sheet S size is changed. For example, when the sheet size is changed from A3 to A4 SEF, the movement of the staple unit 13 is carried out. Further, when the sheet size is changed from A4 SEF to A3, the movement of the staple unit 13 is likewise carried out also.

The moving directions of the staple unit 13 are set according to the sizes of sheets S.

For example, a group of large sheets is set to a group A, and a group of small sheets is set to a group B.

The sheet sizes of the group A include A3, B4, A4LEF, B5LEF, LD, LTLEF, HACHIBIRAKI (273×392 mm), and 7.25×10.5LEF (Executive).

The sheet sizes of the group B include A4SEF, B5SEF, A5LEF, 8.5×14 (LG), 8.5—13.LTSEF, and STLEF.

In the group A, the staple unit 13 is at a home position, and the matching member 101 is not pushed up.

In the group B, the staple unit 13 is pushed into the body device 12 side, and the matching member 101 is pushed up.

Next, the inlet motor 110 and the conveying motor 160 begin to drive.

First, the inlet sensor 21 detects the presence of a sheet S (S5). When a sheet is present, the sheet is conveyed to the first conveying route by the inlet roller. When conveyance of a sheet S for a prescribed distance is detected, the inversion motor 161 starts to drive in normal mode (S6, S7). When the fact that a rear end of a sheet moves away from the inlet sensor is detected, the inversion motor accelerates its rotation (S8, S9).

A sheet S is conveyed to the switch-back route 301 by the switch-back roller 181 and is guided to the inversion tray 50. When the sheet S is conveyed by a prescribed distance (S10), the inversion motor 161 stops (S11). Next, the inversion motor 161 starts its inverted driving (S12). The sheet S is inverted in its upper surface at the time when being taken in from the inlet, and is conveyed from the inversion tray 50 to the second conveying route. When conveyance by a prescribed distance is detected (S22), a paddle solenoid is turned on, and the turning unit 24 is turned to an upper position to guide a sheet S (S23, S24).

When the conveyance of the sheet S by a prescribed distance is detect, (S25) the sheet S is housed in the treating tray 39. Matching of the sheet S housed is carried out (S26). In matching a sheet S, the sheet S is pressed by the pressing means 205 on the reference side of the treating tray 39 to carry out matching. Where the sheet S is not a final sheet, similar operation is repeated from S5 step till the final sheet S is detected (S29).

In case of the final sheet S, the turning unit 24 starts to move down (S28). When being conveyed by a prescribed distance, the conveying motor steps (S31). Here, a stapler motor (not shown) is turned on, and stapling is carried out (S32). Here, the conveying motor 160 starts its driving in normal mode (S33). The driving is transmitted to the discharge roller 25 of the turning unit 24 positioned downward previously (S34). A bundle of sheets S subjected to stapling is discharged onto the treating tray 15. When discharging of the bundle of sheets S is terminated, the inlet motor 110 and the conveying motor 160 stop to terminate the staple treatment (S36, S37).

As explained in detail in the foregoing, the present sheet post-treatment device comprises a first conveying route for receiving a sheet discharged from the image forming apparatus, a switch-back route for inverting the received sheet, a second conveying route for conveying the inverted sheet, and a third conveying route for delivering the conveyed sheet to a treating tray for accumulating and matching it thereon, the switch-back route is arranged below the treating tray and capable of opening the route. And, the third conveying route, the second conveying route and the switch-back route are arranged in a nearly ⊐-shape. Thereby, in the present invention, since the switch-back route is housed in the lower space of the treating tray originally necessitated, the size nearly similar to the sheet post-treatment device having not switch-back function was realized.

We claim:

1. A sheet post-treatment device, comprising:

sheet carrying-in means for receiving a sheet discharged from an image forming apparatus:

switch-back means for switch-back conveying the sheet received from said sheet carrying-in means;

inversion means for inverting both sides of the sheet received from said switch-back means;

discharge means for discharging the sheet whose both sides are inverted by said inversion means;

loading means provided upward of said switch-back means to load the sheet discharged by said discharge means;

post-treatment means for post-treating the sheet loaded on said loading means; and housing means for housing the sheet subjected to post-treatment by said post-treatment means.

2. The sheet post-treatment device according to claim 1, wherein said post-treatment means comprises a post-treatment unit for applying a prescribed post-treatment to the sheet loaded on said loading means, and moving means for moving said post-treatment unit along one end of the sheet loaded on said loading means.

3. The sheet post-treatment device according to claim 2, wherein at least one of said post-treatment means and said moving means is arranged within a region surrounded by said switch-back means, said inversion means, and said loading means.

4. The sheet post-treatment device according to claim 1, wherein said Inversion means comprises a nearly ⊐-shaped conveying route provided between said switch-back means and said loading means.

5. The sheet post-treatment device according to claim 2, wherein said Inversion means comprises a nearly ⊐-shaped conveying route provided between said switch-back means and said loading means.

6. The sheet post-treatment device according to claim 3, wherein said Inversion means comprises a nearly ⊐-shaped conveying route provided between said switch-back means and said loading means.

7. The sheet post-treatment device according to claim 1, wherein said switch-back means has second housing means for temporarily guiding a sheet to be inverted.

8. The sheet post-treatment device according to claim 2, wherein said switch-back means has second housing means for temporarily guiding a sheet to be inverted.

9. The sheet post-treatment device according to claim 3, wherein said switch-back means has second housing means for temporarily guiding a sheet to be inverted.

10. The sheet post-treatment device according to claim 4, wherein said switch-back means has second housing means for temporarily guiding a sheet to be inverted.

11. The sheet post-treatment device according to claim 5, wherein said switch-back means has second housing means for temporarily guiding a sheet to be inverted.

12. The sheet post-treatment device according to claim 6, wherein said switch-back means has second housing means for temporarily guiding a sheet to be inverted.

13. The sheet post-treatment device according to claim 7, wherein said switch-back means discharges a sheet not inverted to said second housing means.

14. The sheet post-treatment device according to claim 8, wherein said switch-back means discharges a sheet not inverted to said second housing means.

15. The sheet post-treatment device according to claim 9, wherein said switch-back means discharges a sheet not inverted to said second housing means.

16. The sheet post-treatment device according to claim 10, wherein said switch-back means discharges a sheet not inverted to said second housing means.

17. The sheet post-treatment device according to claim 11, wherein said switch-back means discharges a sheet not inverted to said second housing means.

18. The sheet post-treatment device according to claim 12, wherein said switch-back means discharges a sheet not inverted to said second housing means.

19. An image forming apparatus, comprising:

sheet feeding means for feeding sheets one by one;

image forming means for forming a desired image on the sheet fed by said sheet feeding means;

sheet carrying-in means for receiving the sheet on which the desired image is formed by said image forming means;

switch-back means for switch-back conveying the sheet received from said sheet carrying-in means;

inversion means for inverting both sides of the sheet received from said switch-back means;

discharge means for discharging the sheet whose both sides are inverted by said invention means;

loading means provided upward of said switch back means to load the sheet discharged from said discharge means;

post-treatment means for applying post-treatment to the sheet loaded on said loading means; and housing means for housing the sheet subjected to post-treatment bys said post-treatment means.

20. The image forming apparatus according to claim 19, wherein said post-treatment means comprises a post-treatment unit for applying prescribed post-treatment to a sheet loaded on said loading means, and moving means for moving said post-treatment unit along one end of the sheet loaded on said loading means; and at least one of said post-treatment means and said moving means is arranged within a region surrounded by said switch-back means, said inversion means and said loading means.

* * * * *